US007677476B2

(12) United States Patent
Burdsall et al.

(10) Patent No.: US 7,677,476 B2
(45) Date of Patent: Mar. 16, 2010

(54) EXTENSION POLE APPARATUS

(75) Inventors: Thomas A. Burdsall, Nashville, TN (US); Lance S. Lindenberg, Hermitage, TN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 690 days.

(21) Appl. No.: 11/166,517

(22) Filed: Jun. 24, 2005

(65) Prior Publication Data

US 2006/0255183 A1 Nov. 16, 2006

Related U.S. Application Data

(60) Provisional application No. 60/676,900, filed on May 2, 2005.

(51) Int. Cl.
*B05B 15/06* (2006.01)

(52) U.S. Cl. ..... 239/532; 239/525; 239/530; 239/583; 239/600; 239/526

(58) Field of Classification Search ..... 239/525–532, 239/195, 587.1, 378, 413, 569, 583, 600; 222/465.1–475.1, 323, 153.01–153.14; 137/383–385
See application file for complete search history.

(56) References Cited

U.S. PATENT DOCUMENTS 3,856,209 A * 12/1974 Hickson ..... 239/532
3,915,382 A * 10/1975 Davis ..... 239/195
4,216,911 A * 8/1980 Huperz et al. ..... 239/526
4,412,656 A * 11/1983 Beck ..... 239/373
4,457,472 A * 7/1984 Geberth, Jr. ..... 239/532
4,673,129 A * 6/1987 Kologiy ..... 239/532
5,236,129 A * 8/1993 Grime et al. ..... 239/528
5,332,159 A * 7/1994 Grime et al. ..... 239/412
5,395,046 A * 3/1995 Knobbe et al. ..... 239/3
5,395,054 A * 3/1995 Wheeler ..... 239/526
5,485,960 A * 1/1996 Troudt ..... 239/532
5,588,495 A * 12/1996 Dear et al. ..... 173/170
5,718,668 A * 2/1998 Arnett et al. ..... 601/155
5,799,835 A * 9/1998 Gobbel ..... 222/174
5,803,313 A * 9/1998 Flatt et al. ..... 222/146.5
5,836,517 A * 11/1998 Burns et al. ..... 239/290
5,904,297 A * 5/1999 Kendrick et al. ..... 239/124
5,966,847 A * 10/1999 Nathenson et al. ..... 37/347
6,079,639 A * 6/2000 Barbato ..... 239/525
6,158,152 A * 12/2000 Nathenson et al. ..... 37/347
6,216,965 B1 * 4/2001 Chao ..... 239/587.4

(Continued)

FOREIGN PATENT DOCUMENTS

CN 1046485 11/1999

*Primary Examiner*—Steven J Ganey
(74) *Attorney, Agent, or Firm*—Jones Day

(57) ABSTRACT

An apparatus includes an extension pole, a hydraulic valve, and a handle containing the valve. The handle has a forward end portion configured to receive the extension pole in an installed position. The handle also has a pistol grip portion inclined from the forward end portion. A valve trigger is supported on the handle. The valve trigger has a pistol grip section that extends along the pistol grip portion of the handle within reach of a user's hand grasping the pistol grip portion from behind. The valve trigger further has an upper grip section that projects forward beneath the installed position of the extension pole within reach of a user's hand grasping the extension pole from above.

36 Claims, 6 Drawing Sheets

U.S. PATENT DOCUMENTS 6,280,072 B1 * 8/2001 Poston ..... 366/1
6,378,922 B1 * 4/2002 Troudt ..... 294/19.1
6,663,307 B2 * 12/2003 Kopanic et al. ..... 401/190
6,786,431 B2 * 9/2004 Song ..... 239/526
6,789,751 B1 * 9/2004 Fan ..... 239/525
6,811,100 B2 * 11/2004 Bardinet et al. ..... 239/532
2002/0066803 A1 * 6/2002 Hsu ..... 239/530
2002/0071710 A1 * 6/2002 Vito ..... 401/266
2002/0134864 A1 * 9/2002 Goodwin et al. ..... 239/532
2003/0071142 A1 * 4/2003 Pohorecki ..... 239/280
2003/0111555 A1 * 6/2003 Song ..... 239/526
2003/0189109 A1 * 10/2003 Bardinet et al. ..... 239/532
2004/0118940 A1 * 6/2004 Lavitt ..... 239/302

* cited by examiner

EXTENSION POLE APPARATUS

RELATED APPLICATIONS

This application claims the benefit of provisional U.S. Patent application No. 60/676,900, filed May 2, 2005, entitled High Pressure Extension Pole, which is incorporated by reference.

TECHNICAL FIELD

This technology relates to an extension pole for a water hose.

BACKGROUND

A person using a water hose, such as a garden hose or a pressure washer hose, may need to extend the reach of the hose beyond the arm's length reach of the user. An extension pole can be used for this purpose. The extension pole may be equipped with a handle containing a valve that directs water from the source hose into an extension hose that extends through the pole. The valve is actuated by a trigger on the handle.

SUMMARY

An apparatus includes an extension pole, a hydraulic valve, and a handle containing the valve. The handle has a forward end portion configured to receive the extension pole in an installed position. The handle also has a pistol grip portion inclined from the forward end portion. A valve trigger is supported on the handle. The valve trigger has a pistol grip section that extends along the pistol grip portion of the handle. That section of the trigger is within reach of a user's hand grasping the pistol grip portion of the handle from behind. The valve trigger further has an upper grip section that projects forward beneath the installed position of the extension pole. That section of the trigger is within reach of a user's hand grasping the extension pole from above.

Summarized differently, an apparatus includes a tubular extension pole, a hydraulic valve having an output fitting, and an extension hose configured to extend in a loop of variable length from the output fitting into the extension pole. The apparatus further includes a handle containing the valve. The handle has a) a forward end portion configured to receive the extension pole in an installed position, b) a rear end portion with an opening, and c) an internal passage configured for the loop to extend into the passage through the opening, through the passage, and into the extension pole through the forward end portion of the handle.

In view of other features, the apparatus can be summarized as including a tubular extension pole having a longitudinal axis, a hose receivable through the pole, and a nozzle structure on the end of the hose. The apparatus further includes a collar that is configured to mate with the nozzle structure to block movement of the nozzle structure axially relative to the collar. A detent mechanism is operative between the collar and the pole. Preferably, another detent mechanism is operative between the pole and the handle.

DETAILED DESCRIPTION

Figure 1:
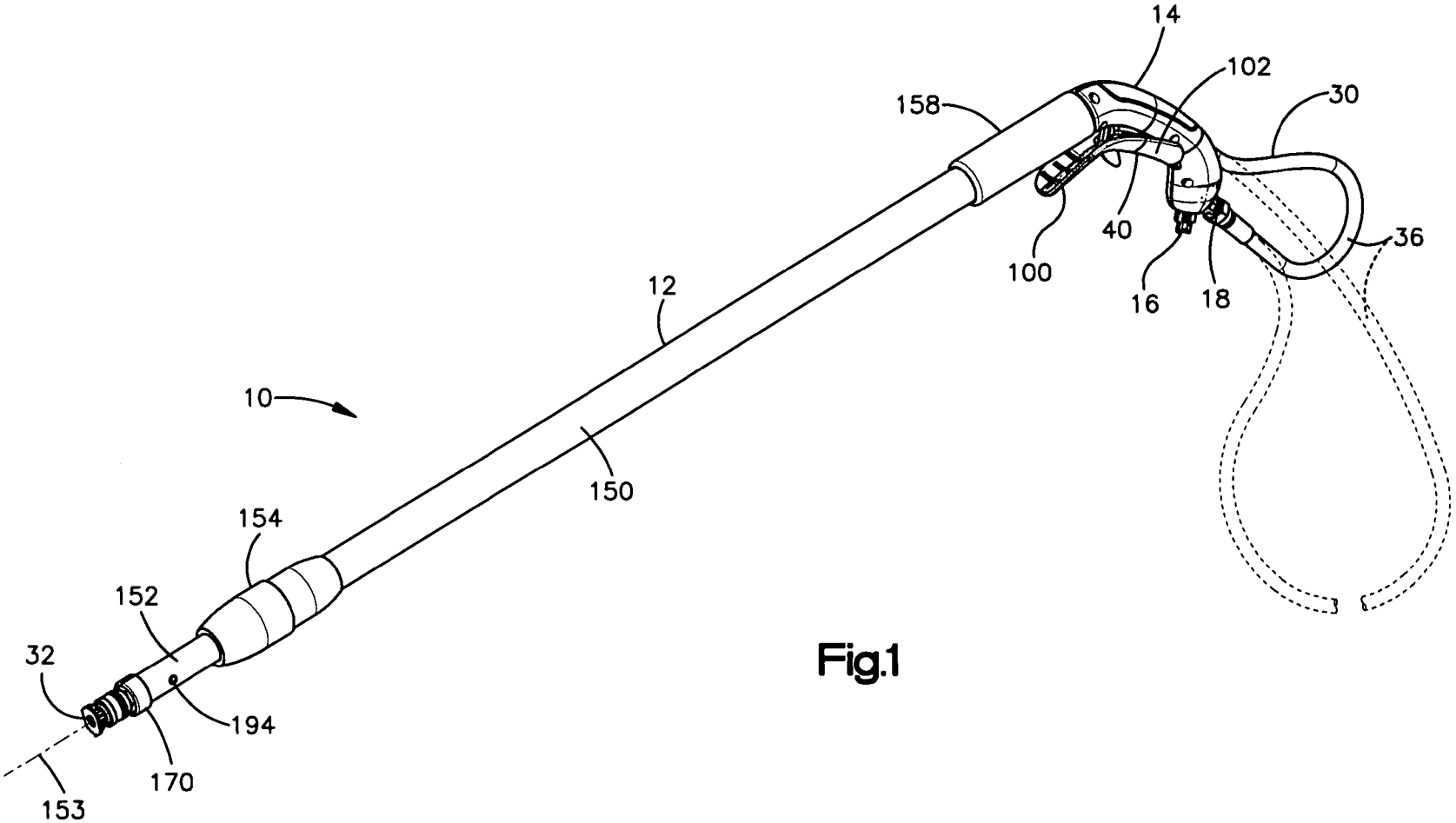
FIG. 1 is a perspective view of a pressure washing device including an extension pole, a hose and a handle.

The apparatus 10 shown in the drawings has parts that are examples of the structural elements recited in the claims. The illustrated apparatus 10 thus includes examples of how a person of ordinary skill in the art can make and use the claimed invention. It is described here to meet the enablement and best mode requirements of the patent statute without imposing limitations that are not recited in the claims.

The illustrated apparatus 10 is a pressure washing device including a telescopic extension pole 12 and a handle 14. The handle 14 contains a hydraulic valve with input and output couplings 16 and 18. The input coupling 16 is configured to receive the output hose of a pressure washer (not shown). An extension hose 30 extends from the output coupling 18 to a nozzle assembly 32 at the outer end of the pole 12. As indicated in the broken line view in FIG. 1, a section of the hose 30 extends in a loop 36 that varies in length upon extension and retraction of the pole 12. A trigger 40 on the handle 14 enables the user to actuate the valve as desired to open a flow path through the device 10 from the input fitting 16 to the nozzle assembly 32.

Figure 2:
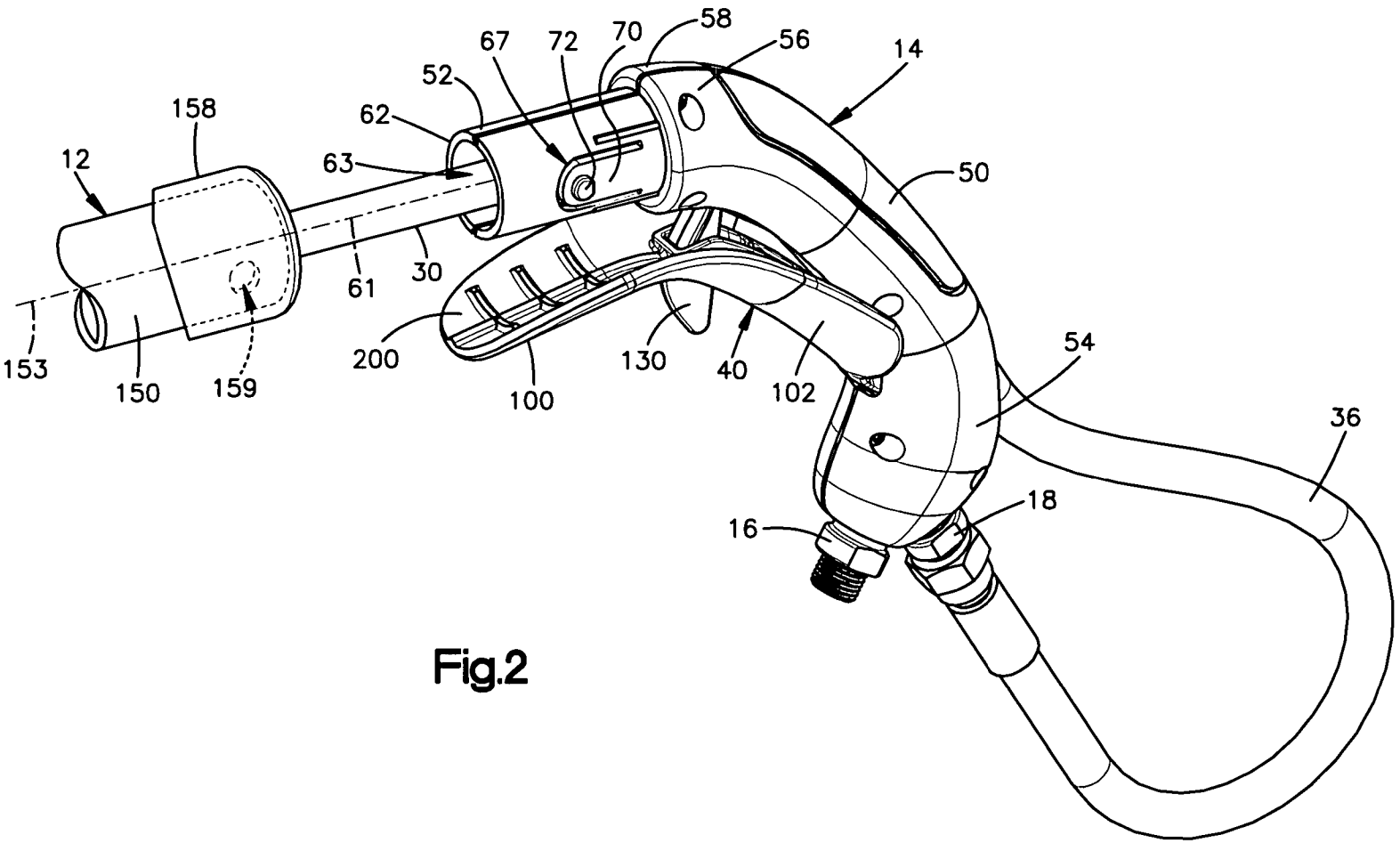
FIG. 2 is an enlarged view of parts shown in FIG. 1.
Figure 3:
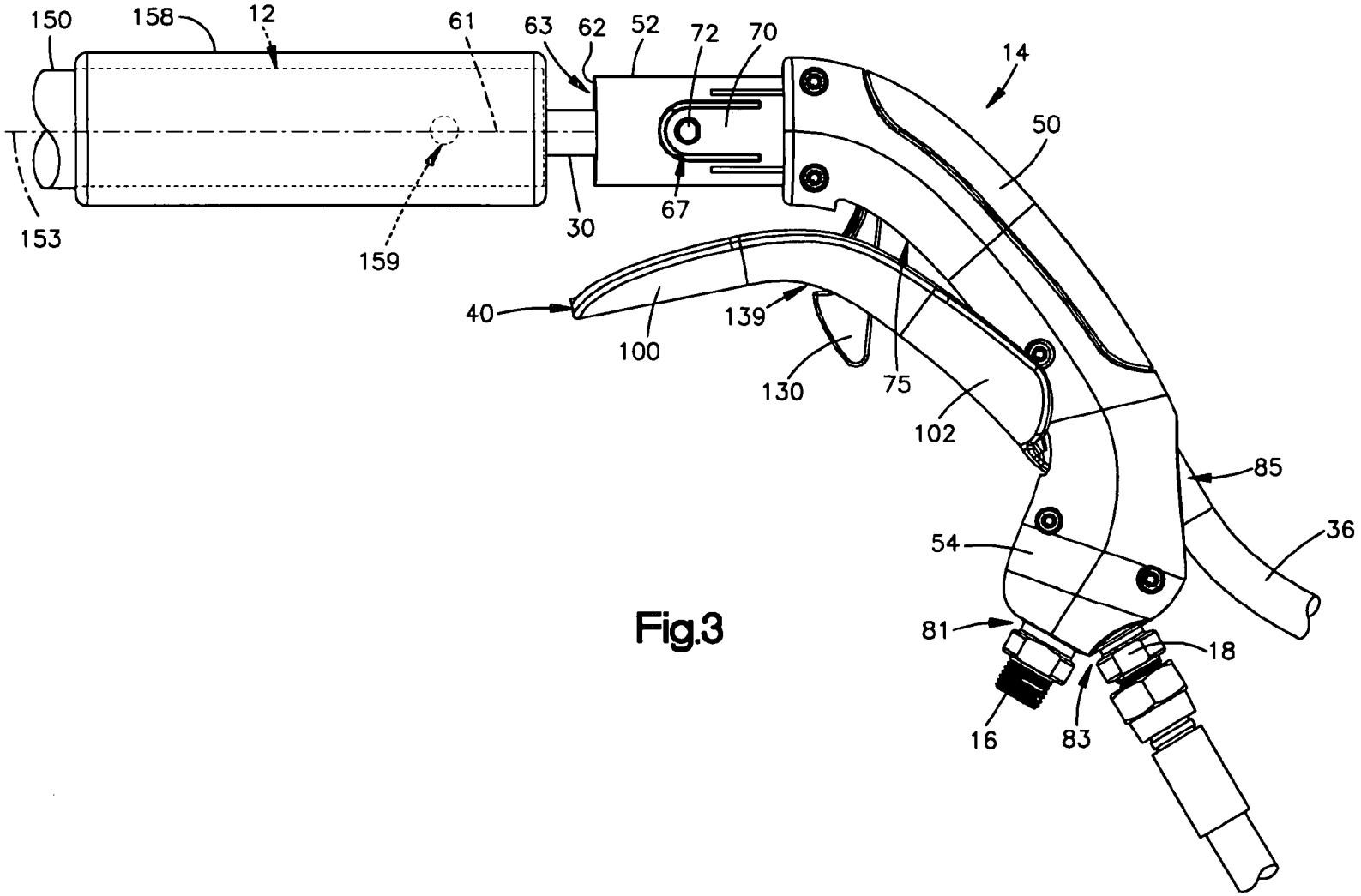
FIG. 3 is a side view of the parts shown in FIG. 2.
Figure 4:
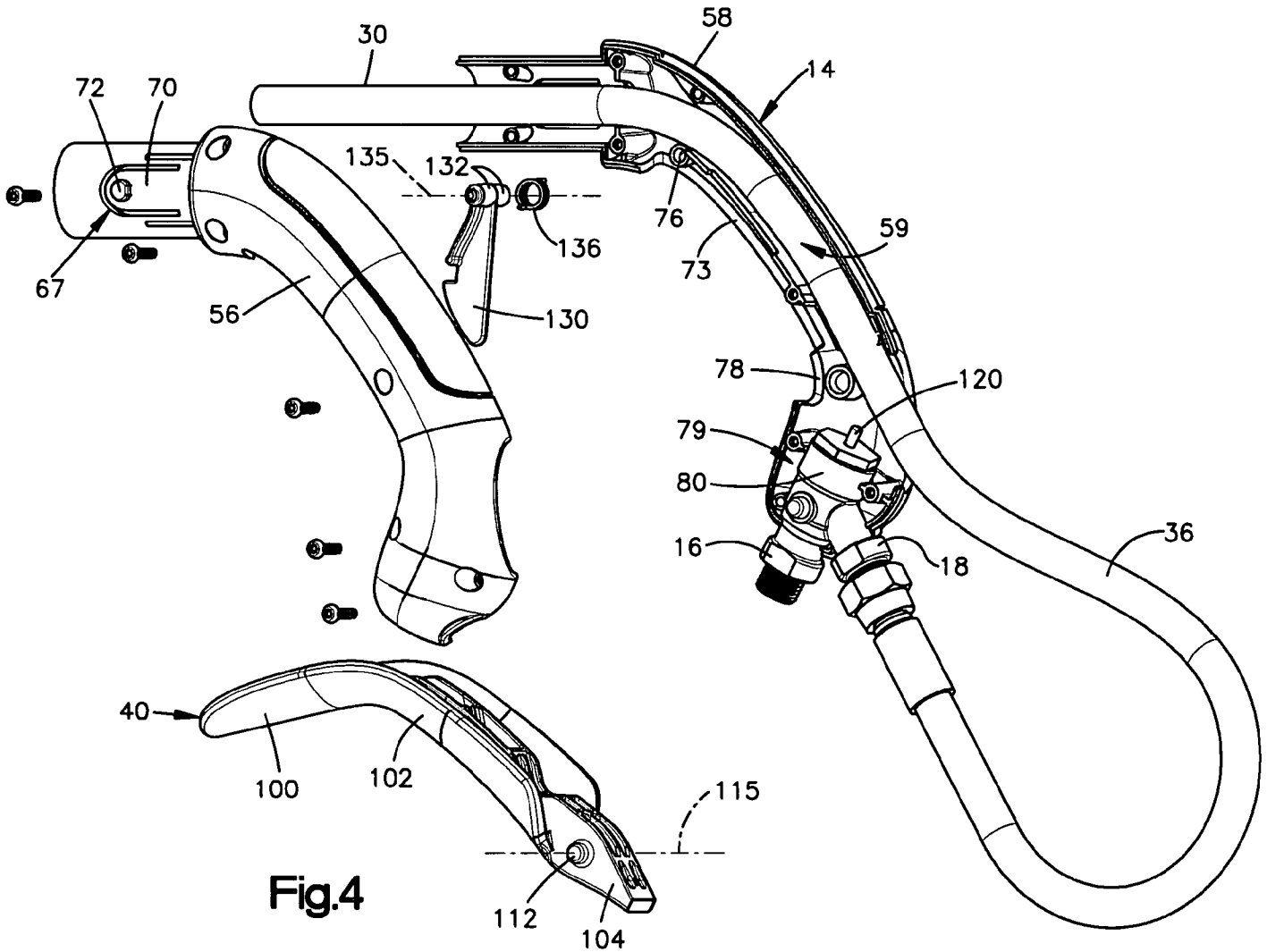
FIG. 4 is an exploded view of parts shown in FIGS. 2 and 3.

As shown in FIGS. 2-4, the handle 14 is elongated with a major length portion 50 configured as a pistol grip. The pistol grip portion 50 of the handle 14 extends rearward and downward from a forward end portion 52 to a lower end portion 54. As shown in the exploded view of FIG. 4, the handle 14 is defined by a pair of opposed halves 56 and 58. Each half 56 and 58 extends along the entire length of the handle 14 such that the two halves 56 and 58 together define all three portions 50, 52 and 54 of the handle 14 when they are fastened together. The assembled handle 14 is a hollow structure with a longitudinally extending passage 59 (FIG. 4) for the hose 30.

The forward end portion 52 of the handle 14 is a cylindrical tube with a longitudinal central axis 61. A circular edge surface 62 defines an opening 63 for the hose 30. A pair of U-shaped slots 67 on the forward end portion 52 have diametrically opposed locations. Each slot 67 defines a radially deflectable locking tab 70. A respective detent member 72 projects radially outward near the forward end of each locking tab 70.

The peripheral configuration of the pistol grip 50 is generally circular and uniform along its length between the forward end portion 52 and the lower end portion 54. The two halves 56 and 58 of the handle 14 have a pair of opposed edge surfaces 73, one of which is shown in FIG. 4. Those edge surfaces 73 together define a slot 75 (FIG. 3) in the pistol grip 50 when the two halves 56 and 58 are fastened together. A pair of opposed counterbore structures 76, one of which also is shown in FIG. 4, are located within the two halves 56 and 58 near the upper end of the slot 75. Another pair of opposed counterbore structures 78 are similarly located near the lower end of the slot 75.

The lower end portion 54 of the handle 14 has a slight radial bulge. The wider configuration of the lower end portion 54 is an ergonomic structural feature that helps to distinguish it from the pistol grip 50, and also provides a chamber 79 for containing the valve 80 (FIG. 4). Like the slot 75 in the pistol grip 50, several additional openings 81, 83 and 85 (FIG. 3) in the lower end portion 54 are defined by opposed edge surfaces of the two halves 56 and 58 of the handle 14. These include a lower opening 81 through which the input coupling 16 projects from the valve 80, another lower opening 83 through which the output coupling 18 projects from the valve 80, and a rear opening 85 for the hose 30.

As noted above, a section of the hose 30 extends in a loop 36. More specifically, the loop 36 begins at the output coupling 18 on the valve 80, and extends into the rear opening 85 in the lower end portion 54 of the handle 14. The loop 36 extends further through the passage 59 in the handle 14, and from the handle 14 into the pole 12 through the opening 63 at the forward end portion 52 of the handle 14. Since the hose is fixed to the nozzle assembly 32 at the outer end of the pole 12, the length of the loop 36 between the output coupling 18 and the opening 63 is increased upon retraction of the pole 12, and is decreased upon extension of the pole 12.

Figure 5:
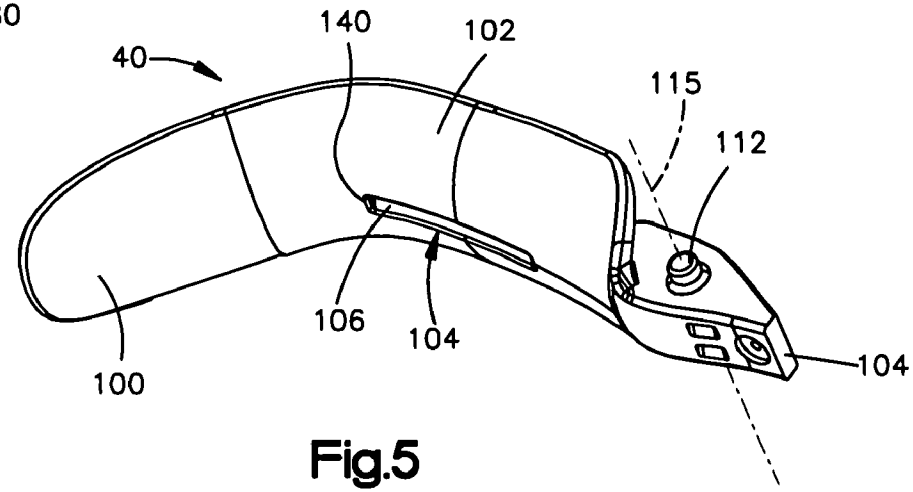
FIG. 5 is a perspective view of a part shown in FIG. 4.

The trigger 40 is an elongated structure with an upper grip section 100, a pistol grip section 102, and a base 104. As shown in FIG. 5, an inner edge surface 106 of the trigger 40 defines a slot 109 in the pistol grip section 102. A pair of stub shafts 112 project from opposite sides of the base 104 along a pivotal axis 115. The stub shafts 106 are received within the lower counterbore structures 78 on the handle 14 to support the trigger 40 for movement pivotally about the axis 115.

The trigger 40 has an unactuated position, as shown in FIGS. 2 and 3. An actuator pin 120 on the valve 80 (FIG. 4) projects upward into engagement with the base portion 104 of the trigger 40. Accordingly, when the trigger 40 is moved from the unactuated position in a clockwise direction, as viewed in the drawings, the base portion 104 of the trigger 40 pushes the actuator pin 120 inward of the valve 80. This shifts the valve 80 into and through a range of increasingly open conditions. A return spring in the valve 80 urges the actuator pin 120 back outward toward the original position in which the valve 80 is closed and the trigger 40 is located in the unactuated position.

A spring-loaded safety latch 130 ordinarily retains the trigger 40 in the unactuated position. A pair of stub-shafts 132 (FIG. 4) on the latch 130 are received in the upper counterbore structures 76 on the handle 14 to support the latch 130 for movement pivotally about an axis 135 parallel to the axis 115, with the latch 130 projecting downward through the slot 109 in the trigger 40. A spring 136 acts between the handle 14 and the latch 130 to urge it into a locking position in which a notch 139 on the latch 130 is received over an edge portion 140 (FIG. 5) of the trigger 40 beside the slot 109.

The illustrated example of an extension pole 12 is a tubular cylindrical structure with first and second sections 150 and 152 centered on a longitudinal axis 153. The extension pole 12 further has a screw-threaded fitting 154 which, as known in the art, can be loosened to permit movement of the second section 152 telescopically within the first section 150, and tightened to retain the second section 152 in a selected position for a selected length of the pole 12. A compressible foam hand grip 158 is received over the first section 150 of the pole 12.

The pole 12 is installed on the handle 14 by sliding the first section 150 of the pole 12 coaxially over the forward end portion 52 of the handle 14 until the detent members 72 on the handle 14 snap into a corresponding pair of apertures 159 in the pole 12. The user can slide the hand grip 158 forward over the first section 150 of the pole 12 as needed to access the detent members 72.

Figure 6:
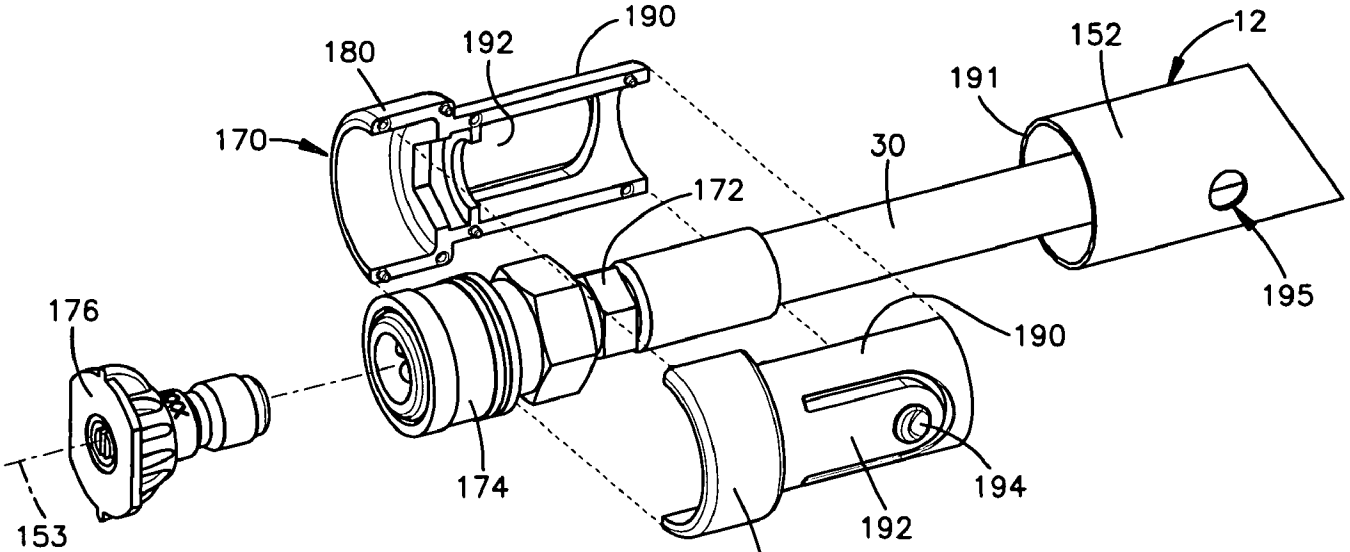
FIG. 6 is an exploded view of other parts shown in FIG. 1.

A collar 170 (FIG. 1) attaches the hose 30 to the outer end of the second pole section 152. As shown in enlarged detail in FIG. 6, the hose 30 has a nozzle fitting 172. The nozzle assembly 32 includes a quick-connect receptacle 174 that is mounted on the nozzle fitting 172. The nozzle assembly 32 further includes a plurality of interchangeable nozzle tips 176, one of which is shown as an example in FIG. 6. The collar 170 is an elongated cylindrical structure with two opposed halves 180 that are receivable coaxially over the nozzle fitting 172. Inner surfaces of the collar halves 180 are configured to mate with corresponding outer surfaces of the fitting 172 to block movement of the collar 170 and the fitting 172 axially relative to each other. Rear sections 190 of the collar halves 180 are receivable together within the open end 191 of the second hose section 152. The rear sections 190 of the collar halves 180 have flexible locking tabs 192 with detent members 194 that are receivable through a corresponding pair of apertures 195 in the second hose section 152.

Figure 7:
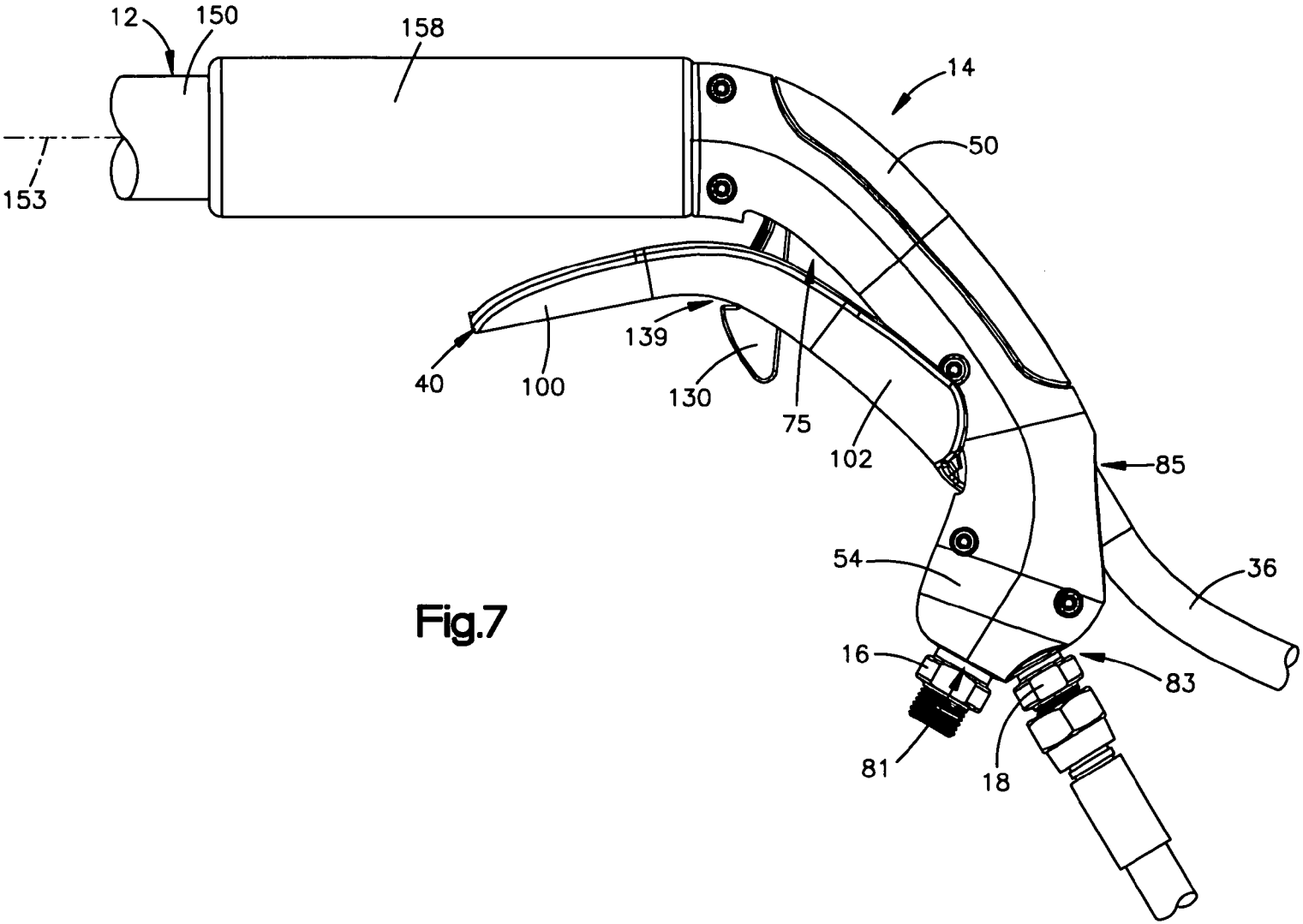
FIG. 7 is a side view of parts shown in FIG. 1.

With the device 10 assembled as shown in FIG. 1, the user can actuate the valve 80 by grasping and pivoting the trigger 40 from either of two different hand positions. The first hand position is on the pistol grip portion 50 of the handle 14. As best shown in the side view of FIG. 7, the pistol grip section 102 of the trigger 40 is within reach of a user's hand grasping the pistol grip portion 50 of the handle 14 from behind. The second hand position is on the extension pole 12 where the pole 12 overlies the front end portion 50 of the handle 14. As best shown in the side view of FIG. 3, the upper grip section 100 of the trigger 40 projects forward beneath and beyond the forward end portion 52 of the handle 14. Accordingly, as shown in FIG. 7, the upper grip section 100 of the trigger 40 projects forward beneath the installed position of the pole 12 to be within reach of a user's hand grasping the hand grip 158 (or the pole 12 without the handgrip 158) from above. A concave upper surface 200 (FIG. 2) of the trigger 40 has a generally cylindrical contour for the upper section 100 of the trigger 40 to mate with the hand grip 158 when the trigger 40 is fully actuated.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that occur to those skilled in the art. Such other examples, which may be available either before or after the application filing date, are intended to be within the scope of the claims if they have elements that do not differ from the literal language of the claims, or if they have equivalent elements with insubstantial differences from the literal language of the claims.

The invention claimed is:

1. An apparatus comprising:

an extension pole having a longitudinal axis and an axially elongated, radially enlarged hand grip portion;

a hydraulic valve;

a handle containing said valve, said handle having a forward end portion configured to receive said extension pole in an installed position in which said hand grip portion of said extension pole projects forward from said forward end portion of said handle, and having a pistol grip portion inclined from said forward end portion; and a valve trigger supported on said handle, said valve trigger having a pistol grip section that extends along said pistol grip portion of said handle within reach of a user's hand grasping said pistol grip portion from behind, and further having an upper grip section that projects forward directly beneath said hand grip portion of said extension pole within reach of a user's hand grasping said hand grip portion of said extension pole from directly above.

2. An apparatus as defined in claim 1 wherein said upper grip section of said valve trigger is configured to move into and out of contact with said hand grip portion of said extension pole upon moving into and out of an actuated position.

3. An apparatus as defined in claim 2 wherein said upper grip section of said valve trigger has a concave upper surface with a generally cylindrical contour configured to mate with a cylindrical surface of said hand grip portion of said extension pole.

4. An apparatus as defined in claim 1 wherein said hand grip portion of said extension pole extends over said forward end portion of said handle when said extension pole is in said installed position.

5. An apparatus as defined in claim 1 wherein said hand grip portion of said extension pole is formed of compressible foam.

6. An apparatus as defined in claim 1 wherein said extension pole has a section that is releasably fixed relative to said handle when said extension pole is in said installed position.

7. An apparatus as defined in claim 1 wherein said extension pole and said handle have means for said extension pole to snap into releasable interlocked engagement with said handle.

8. An apparatus as defined in claim 6 wherein said hand grip portion of said extension pole covers said means when said extension pole is in said installed position.

9. An apparatus comprising:

an extension pole;

a hydraulic valve;

a handle containing said valve, said handle having a forward end portion configured to receive said extension pole in an installed position in which an elongated portion of said extension pole projects forward from said forward end portion of said handle, and having a pistol grip portion inclined from said forward end portion; and a valve trigger supported on said handle, said valve trigger having a pistol grip section that extends along said pistol grip portion of said handle within reach of a user's hand grasping said pistol grip portion from behind, and further having an upper grip section that projects forward directly beneath said elongated portion of said extension pole within reach of a user's hand grasping said elongated portion of said extension pole from directly above;

said valve trigger being linked to said valve to shift said valve into an open condition when a user grasps and moves said pistol grip section of said trigger in an actuating direction rearward toward said pistol grip portion of said handle, and also to shift said valve into an open condition when a user grasps and moves said upper grip section of said trigger in an actuating direction upward toward said elongated portion of said extension pole.

10. An apparatus as defined in claim 9 wherein said pistol grip section and said upper grip section of said valve trigger are immovable relative to each other.

11. An apparatus as defined in claim 9 wherein said valve trigger has a base supported on said handle for movement pivotally about a single axis at said base, said pistol grip section of said valve trigger projects upward from said base and is movable in said rearward actuating direction pivotally about said single axis, and said upper grip section of said valve trigger extends forward from said pistol grip section and is movable in said upward actuating direction pivotally about said single axis.

12. An apparatus as defined in claim 9 wherein said upper grip section of said valve trigger has a free end defining a terminal forward end of said valve trigger at a location forward of said handle.

13. An apparatus as defined in claim 9 wherein said upper grip section of said valve trigger is movable in said upward actuating direction to actuate said valve while said extension pole remains stationary in said installed position.

14. An apparatus as defined in claim 9 wherein said valve is operative independently of the position of said extension pole.

15. An apparatus as defined in claim 9 wherein said pistol grip section of said valve trigger is movable in said rearward actuating direction pivotally about a single axis, and said upper grip section of said valve trigger and is movable in said upward actuating direction pivotally about said single axis.

16. An apparatus as defined in claim 9 wherein said extension pole has a section that is releasably fixed relative to said handle when said extension pole is in said installed position.

17. An apparatus as defined in claim 9 wherein said extension pole and said handle have means for said extension pole to snap into releasable interlocked engagement with said handle.

18. An apparatus comprising:

an extension pole;

a hydraulic valve;

a handle containing said valve, said handle having a forward end portion configured to receive said extension pole in an installed position, and having a pistol grip portion inclined from said forward end portion; and a valve trigger supported on said handle, said valve trigger having a pistol grip section that extends along and beside said pistol grip portion of said handle and further having an upper grip section that extends along and beneath said forward end portion of said handle;

said valve trigger being linked to said valve to shift said valve into an open condition when a user grasps and moves said pistol grip section of said trigger in an actuating direction rearward toward said pistol grip portion of said handle, and also to shift said valve into an open condition when a user grasps and moves said upper grip section of said trigger in an actuating direction upward toward said forward end portion of said handle;

said pistol grip section and said upper grip section of said valve trigger being immovable relative to each other.

19. An apparatus as defined in claim 18 wherein said upper grip section of said valve trigger is movable in said upward actuating direction to actuate said valve while said extension pole remains stationary in said installed position.

20. An apparatus as defined in claim 18 wherein said valve is operative independently of the position of said extension pole.

21. An apparatus as defined in claim 18 wherein said valve trigger has a base supported on said handle for movement pivotally about a single axis at said base, said pistol grip section of said valve trigger projects upward from said base and is movable in said rearward actuating direction pivotally about said single axis, and said upper grip section of said valve trigger extends forward from said pistol grip section and is movable in said upward actuating direction pivotally about said single axis.

22. An apparatus as defined in claim 18 wherein said pistol grip section of said valve trigger is movable in said rearward actuating direction pivotally about a single axis, and said upper grip section of said valve trigger and is movable in said upward actuating direction pivotally about said single axis.

23. An apparatus as defined in claim 18 wherein said extension pole has a section that is releasably fixed relative to said handle when said extension pole is in said installed position.

24. An apparatus as defined in claim 18 wherein said extension pole and said handle have means for said extension pole to snap into releasable interlocked engagement with said handle.

25. An apparatus as defined in claim 18 wherein said extension pole has a hand grip portion that extends over said forward end portion of said handle when said extension pole is in said installed position.

26. An apparatus as defined in claim 25 wherein said hand grip portion of said extension pole is formed of compressible foam.

27. An apparatus comprising:

an extension pole;

a hydraulic valve;

a handle containing said valve, said handle having a forward end portion configured to receive said extension pole in an installed position, and having a pistol grip portion inclined from said forward end portion; and a valve trigger supported on said handle, said valve trigger having a pistol grip section that extends along and beside said pistol grip portion of said handle and further having an upper grip section that extends along and beneath said forward end portion of said handle;

said valve trigger being linked to said valve to shift said valve into an open condition when a user grasps and moves said pistol grip section of said trigger in an actuating direction rearward toward said pistol grip portion of said handle, and also to shift said valve into an open condition when a user grasps and moves said upper grip section of said trigger in an actuating direction upward toward said forward end portion of said handle;

said upper grip section of said valve trigger having a free end defining a terminal forward end of said valve trigger at a location forward of said handle.

28. An apparatus as defined in claim 27 wherein said upper grip section of said valve trigger is movable in said upward actuating direction to actuate said valve while said extension pole remains stationary in said installed position.

29. An apparatus as defined in claim 27 wherein said valve is operative independently of the position of said extension pole.

30. An apparatus as defined in claim 27 wherein said pistol grip section and said upper grip section of said valve trigger are immovable relative to each other.

31. An apparatus as defined in claim 27 wherein said valve trigger has a base supported on said handle for movement pivotally about a single axis at said base, said pistol grip section of said valve trigger projects upward from said base and is movable in said rearward actuating direction pivotally about said single axis, and said upper grip section of said valve trigger extends forward from said pistol grip section and is movable in said upward actuating direction pivotally about said single axis.

32. An apparatus as defined in claim 27 wherein said pistol grip section of said valve trigger is movable in said rearward actuating direction pivotally about a single axis, and said upper grip section of said valve trigger and is movable in said upward actuating direction pivotally about said single axis.

33. An apparatus as defined in claim 27 wherein said extension pole has a section that is releasably fixed relative to said handle when said extension pole is in said installed position.

34. An apparatus as defined in claim 27 wherein said extension pole and said handle have means for said extension pole to snap into releasable interlocked engagement with said handle.

35. An apparatus as defined in claim 27 wherein said extension pole has a hand grip portion that extends over said forward end portion of said handle when said extension pole is in said installed position.

36. An apparatus as defined in claim 35 wherein said hand grip portion of said extension pole is formed of compressible foam.

* * * * *